US008803081B2

(12) United States Patent
Kenny

(10) Patent No.: US 8,803,081 B2
(45) **Date of Patent: *Aug. 12, 2014**

(54) MASS SPECTROMETER ARRANGED TO PERFORM MS/MS/MS

(71) Applicant: Micromass UK Limited, Manchester (GB)

(72) Inventor: Daniel James Kenny, Knutsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/891,718

(22) Filed: May 10, 2013

(65) Prior Publication Data

US 2013/0248704 A1 Sep. 26, 2013

Related U.S. Application Data

(63) Continuation of application No. 13/145,375, filed as application No. PCT/GB2010/000079 on Jan. 20, 2010, now Pat. No. 8,445,843.

(60) Provisional application No. 61/156,146, filed on Feb. 27, 2009.

(30) Foreign Application Priority Data

Jan. 21, 2009 (GB) ..... 0900973.9

(51) Int. Cl.
*H01J 49/42* (2006.01)
*H01J 49/46* (2006.01)

(52) U.S. Cl.
USPC ..... 250/282; 250/281; 250/288; 250/292; 250/283

(58) Field of Classification Search
USPC ..... 250/282, 281, 292, 283, 288
See application file for complete search history.

(56) References Cited

U.S. PATENT DOCUMENTS

| | | | |
|---|---|---|---|
| 4,749,860 | A | 6/1988 | Kelley et al. |
| 4,882,484 | A | 11/1989 | Franzen et al. |
| 5,134,286 | A | 7/1992 | Kelley |
| 5,179,278 | A | 1/1993 | Douglas |
| 6,011,259 | A | 1/2000 | Whitehouse et al. |

(Continued)

FOREIGN PATENT DOCUMENTS

JP 2005078804 3/2005

OTHER PUBLICATIONS

Campbell et al, "*A New Linear Ion Trap Time-of-Flight System With Tandem Mass Spectromeny Capabilities*" Rapid Communications in Mass Spectrometry, vol. 12, pp. 1463-1474, 1998.

(Continued)

*Primary Examiner* — Nikita Wells
(74) *Attorney, Agent, or Firm* — Diederiks & Whitelaw, PLC

(57) ABSTRACT

A mass spectrometer is disclosed comprising an ion trap and a fragmentation device. Ions are fragmented in the ion trap to form first generation fragment ions. The ion trap has a relatively high mass cut-off. The first generation fragment ions are then transferred to a fragmentation device which is arranged to have a substantially lower low mass cut-off. The first generation fragment ions are fragmented within the fragmentation device any may optionally be stored in an ion accumulation region prior to being passed to a mass analyzer for subsequent mass analysis.

16 Claims, 5 Drawing Sheets

(56) References Cited

U.S. PATENT DOCUMENTS

| | | | | |
|---|---|---|---|---|
| 6,483,109 | B1 | 11/2002 | Reinhold et al. | |
| 6,833,544 | B1 | 12/2004 | Campbell et al. | |
| 6,924,478 | B1 | 8/2005 | Zubarev et al. | |
| 7,049,580 | B2 | 5/2006 | Londry et al. | |
| 7,189,967 | B1 | 3/2007 | Whitehouse et al. | |
| 7,227,137 | B2 | 6/2007 | Londry et al. | |
| 7,405,401 | B2 | 7/2008 | Hoyes | |
| 7,622,712 | B2 * | 11/2009 | Hager | 250/283 |
| 7,985,948 | B2 * | 7/2011 | Bonner et al. | 250/281 |
| 8,445,843 | B2 * | 5/2013 | Kenny | 250/282 |
| 2003/0122071 | A1 | 7/2003 | Plomley et al. | |
| 2003/0168589 | A1 | 9/2003 | Hager | |
| 2004/0021070 | A1 | 2/2004 | Bateman et al. | |
| 2005/0098719 | A1 | 5/2005 | Thomson | |
| 2008/0315082 | A1 | 12/2008 | Ogata et al. | |
| 2010/0065733 | A1 | 3/2010 | Bateman et al. | |
| 2010/0108878 | A1 | 5/2010 | Bateman et al. | |
| 2010/0252730 | A1 | 10/2010 | Green et al. | |
| 2011/0204221 | A1 | 8/2011 | Satake et al. | |
| 2012/0193526 | A1 | 8/2012 | Kovtoun | |

OTHER PUBLICATIONS

Collings et al., "*MS/MS of Ions in a Low Pressure Linear Ion Trap Using a Pulsed Gas*" J Am Soc Mass Spectrom, vol. 20, pp. 1714-1717, 2009.

Collings et al, "Resonant Excitation in a Low-Pressure Linear Ion Trap" J Am Soc Mass Spectrom, vol. 14, pp. 622-632, 2003.

Doroshenko et al,"*Pulsed Gas Introduction for Increasing Peptide CID Efficiency in a MALDI/Quadrupole Ion Trap Mass Spectrometer*" Analytical Chemistry, vol. 68, No. 3, pp. 463-472, 1996.

Watson et al., "*A Technique for Mass Selective Ion Rejection in a Quadrupole Reaction Chamber*" International Journal of Mass Spectrometry, vol. 93, pp. 225-235, 1989.

* cited by examiner

MASS SPECTROMETER ARRANGED TO PERFORM MS/MS/MS

CROSS REFERENCE TO RELATED APPLICATIONS

This application is a continuation of U.S. patent application Ser. No. 13/145,375 filed Jul. 20, 2011, which is the National Stage of International Application No. PCT/GB2010/000079, filed Jan. 20, 2010, which claims benefit of and priority to U.S. Provisional Patent Application No. 61/156,146, filed on Feb. 27, 2009 and United Kingdom Application No. 0900973.9 which was filed on Jan. 21, 2009. The contents of these applications are expressly incorporated herein by reference in their entirety.

BACKGROUND OF THE INVENTION

The present invention relates to a mass spectrometer and a method of mass spectrometry. The preferred embodiment relates to a method of performing $MS^3$ or MS/MS/MS.

Mass isolation was performed in a linear ion trap ("LIT") by Beaugrand et al. and was presented at ASMS 1988 (ASMS 1988 abstracts page 811).

Further work was published by Watson et al. in 1989 ("A technique for mass selective ion rejection in a quadrupole reaction chamber", Int. J. Mass Spec. Ion Proc. 93, 225-235 (1989)). In this article an arrangement was disclosed comprising a penta-quad instrument comprising an EI/CI ion source, a mass selective quadrupole Q1, a first collision cell C1 comprising an RF-only quadrupole, a second mass selective quadrupole Q2, a second collision cell C2 comprising two RF-only quadrupoles, a third mass selective quadrupole Q3 and an electron multiplier detector. The first collision cell C1 was maintained at a pressure of $1\times10^{-3}$ after the first resolving quadrupole Q1 was used to trap and then selectively eject ions by the application of a dipolar excitation. The isolated ions thus remaining were then released and mass analysed in one of two further resolving quadrupoles. It was suggested that the same auxiliary RF excitation could be used to increase the kinetic energy of the ions so as to induce fragmentation via collision induced dissociation ("CID").

A disclosure at ASMS in 1989 ("How to use a standard quadrupole filter as a two dimensional ion-trap", C Beaugrand et al., Proceedings of ASMS 1989, p. 466) reported using a single quadrupole operating as a linear ion trap wherein mass selection of parent/daughter ions and CID fragmentation was achieved in the linear ion trap by firstly filling the ion trap. Precursor ions were then isolated. In a following step CID fragmentation was performed via excitation and daughter ions were then isolated before being detected.

A further instance of mass isolation and fragmentation in a linear ion trap prior to mass analysis was disclosed in U.S. Pat. No. 5,179,278. U.S. Pat. No. 517,278 discloses isolation and fragmentation in a linear ion trap prior to mass analysis in a 3D ion trap.

U.S. Pat. No. 6,011,259 discloses mass isolation and fragmentation in a linear ion trap prior to mass analysis in a Time of Flight mass analyser. Use of this apparatus was reported at ASMS 1998 (ASMS 1998 abstracts, p. 39).

Campbell et al. described a similar experimental setup (ASMS 1998 abstracts, p. 40) which allowed $MS^n$ in a linear ion trap prior to analysis by a Time of Flight mass analysers. Further results using this instrument were published by Campbell et al. ("A New Linear Ion Trap Time-of-flight System with Tandem Mass Spectrometry Capabilities", Rapid Commun. Mass Spectrom. 12, 1463-1474 (1998)).

In U.S. Pat. No. 6,833,544 a mass spectrometer is disclosed wherein precursor isolation was performed in a quadrupole mass filter (QMF) followed by $MS^n$ analysis in a linear ion trap, followed by final mass analysis in a third device. With this geometry the first MS step to isolate the precursor is performed in the first quadrupole Q1, the linear ion trap steps are performed in the second quadrupole Q2 (i.e. the gas cell) and the mass analyser could be one of several devices.

U.S. Pat. Nos. 7,049,580 and 7,227,137 disclose fragmentation in linear ion traps.

It is often necessary to determine the identity or internal structure of a compound and a common method used for this purpose is MS/MS (or $MS^2$) analysis whereby a target compound having a specific mass to charge ratio is first isolated and then fragmented. The resultant fragment ions are then mass analysed. In certain situations such an approach is either not sufficiently specific or else further structural information is required. If further structural information is required then a MS/MS/MS (or $MS^3$) analysis may be performed whereby a target compound is isolated and fragmented. One of the resultant first generation fragment ions is then isolated and is further fragmented to form a plurality of second generation fragment ions. Successive repeats of isolation and fragmentation steps may be strung together in instruments such as ion traps and the general technique is commonly known as $MS^n$.

A major problem with known instruments is that they suffer from a problem known as low mass cut-off ("LMCO") wherein the RF voltage which is applied to the ion trap in order to contain or radially confine the isolated precursor or parent ions within the ion trap is not also suitable for retaining low mass or low mass to charge ratio fragment ions which are subsequently created when the precursor or parent ions are fragmented within the ion trap. This low mass cut-off effectively limits the mass range or mass to charge ratio range of fragment ion mass spectra that can be produced.

In addition, 3D ion traps are not regarded as being particularly good mass analysers and there have been several attempts to produce a hybrid geometry instrument wherein the isolation and fragmentation steps are performed in a linear trap before being passed directly to a Time of Flight ("TOF") mass analyser for the final mass analysis step. Attempts at coupling linear traps to quadrupoles for the final mass analysis step have been limited to monitoring single masses as scanning quadrupole spectra are unable to be acquired due to the pulsed nature of the release of ions from the linear ion trap.

It is desired to provide an improved mass spectrometer and method of mass spectrometry.

SUMMARY OF THE INVENTION

According to an aspect of the present invention there is provided a method of mass spectrometry comprising:

isolating ions of interest in an ion trap;

fragmenting at least some of the ions of interest to form a plurality of first fragment ions;

transferring at least some of the first fragment ions to a fragmentation device which is arranged either upstream or downstream of the ion trap; and fragmenting at least some the first fragment ions within the fragmentation device to form a plurality of second fragment ions.

The ion trap is preferably operated in a mode of operation and has an effective first low mass or mass to charge ratio cut-off and the fragmentation device is preferably operated in a mode of operation and has an effective second low mass or mass to charge ratio cut-off, wherein the second low mass or mass to charge ratio cut-off is preferably substantially lower than the first low mass or mass to charge ratio cut-off.

According to an embodiment the second low mass or mass to charge ratio cut-off is at least 5%, 10%, 15%, 20%, 25%, 30%, 35%, 40%, 45%, 50%, 55%, 60%, 65%, 70%, 75%, 80%, 85%, 90%, 95% or 100% lower than the first low mass or mass to charge ratio cut-off.

According to an embodiment the ion trap may be selected from the group consisting of: (i) a quadrupole rod set; (ii) a hexapole rod set; (iii) an octapole or higher order rod set; (iv) an ion tunnel or ion funnel ion trap comprising a plurality of electrodes each having one or more apertures through which ions are transmitted in use; (v) a 2D or linear ion trap; and (vi) a 3D or Paul ion trap.

According to an embodiment the fragmentation device may be selected from the group consisting of: (i) a quadrupole rod set; (ii) a hexapole rod set; (iii) an octapole or higher order rod set; (iv) an ion tunnel or ion funnel ion trap comprising a plurality of electrodes each having one or more apertures through which ions are transmitted in use; (v) a 2D or linear ion trap; and (vi) a 3D or Paul ion trap.

For ion traps with a quadrupole geometry the stability of ions within the ion trap may be represented by the Mathieu stability parameter 'q'. Quadrupole theory determines that ions that have a q value above 0.908 are unstable within the ion trap and are lost to the system. Consequently, for a given set of operating conditions there is a mass to charge ratio value below which ions are not trapped. The mass to charge ratio at which this occurs is widely known as the low mass cut-off ("LMCO"). The approach for determining the LMCO for multipoles of higher order (i.e. hexapoles, octopoles etc.) and other devices such as ion tunnels is slightly different and may be defined as being the mass to charge ratio at which only a minor proportion or 50% of the ions of a particular mass to charge ratio remain confined within the ion trap for a substantive period of time.

According to an embodiment the low mass cut-off of the ion trap and/or the fragmentation device may be defined as the mass to charge ratio at which 50%, 45%, 40%, 35%, 30%, 25%, 20%, 15%, 10%, 5% or 1% of the ions of a particular mass to charge ratio remain confined within the ion trap and/or fragmentation device for a substantive period of time (e.g. >10 ms or >100 ms).

The ion trap preferably comprises a different number of electrodes or is structurally different to the fragmentation device so that for ions having a particular mass to charge ratio the ion trap has a first low mass cut-off and the fragmentation device has a second different (lower) low mass cut-off.

According to an embodiment the second low mass or mass to charge ratio cut-off is at least 5%, 10%, 15%, 20%, 25%, 30%, 35%, 40%, 45%, 50%, 55%, 60%, 65%, 70%, 75%, 80%, 85%, 90%, 95% or 100% lower than the first low mass or mass to charge ratio cut-off.

The ion trap preferably comprises a first plurality of electrodes having a first spacing and/or aperture size and/or diameter and the fragmentation device preferably comprises a second plurality of electrodes having a second different spacing and/or aperture size and/or diameter.

According to an embodiment the mass spectrometer further comprises a device arranged and adapted to supply an AC or RF voltage to the electrodes comprising the ion trap wherein:

(a) the AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and (b) the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the mass spectrometer further comprises a device arranged and adapted to supply an AC or RF voltage to the electrodes comprising the fragmentation device wherein:

(a) the AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and (b) the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the RF voltage applied to the electrodes forming the ion trap and the fragmentation device may be arranged to be at substantially the same frequency but the amplitude of the RF voltage applied to the electrodes of the fragmentation device may be reduced (or less preferably increased) relative to the amplitude of the RF voltage applied to the electrodes forming the ion trap.

According to an embodiment the amplitude of the RF voltage applied to the electrodes forming the ion trap and the fragmentation device may be arranged to be substantially the same but the frequency of the RF voltage applied to the electrodes of the fragmentation device may be increased (or less preferably reduced) relative to the frequency of the RF voltage applied to the electrodes forming the ion trap.

Another embodiment is contemplated wherein the RF voltages applied to the electrodes of the ion trap and the fragmentation device may be arranged to have a different pattern, arrangement or order. For example, according to an embodiment two adjacent electrodes of the ion trap may be maintained at the same phase followed by two following electrodes being maintained at the opposite phase with this pattern, arrangement or order being repeated along the ion trap (e.g. ++−−++−−++ etc.). By contrast, adjacent electrodes of the fragmentation device may be arranged at opposite phases (e.g. +−+−+−+−+− etc.). Other variations are also contemplated including reversing the phase pattern, arrangement or order discussed above so that adjacent electrodes of the ion trap are arranged at opposite phases (e.g. +−+−+−+−+− etc.) and two adjacent electrodes of the fragmentation device may be maintained at the same phase followed by two following electrodes being maintained at the opposite phase with this pattern, arrangement or order being repeated along the fragmentation device (e.g. ++−−++−−++ etc.).

According to an embodiment the method further comprises:

accumulating at least some of the second fragment ions in an ion accumulation device or ion trap; and releasing at least some of the second fragment ions from the ion accumulation device or ion trap and transferring the second fragment ions to a mass analyser for subsequent mass analysis.

According to another embodiment the method preferably further comprises transferring the second fragment ions to a mass analyser for subsequent mass analysis.

The mass analyser is preferably selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap (RTM) mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The method preferably further comprises arranging or providing one or more axial RF or axial pseudo-potential barriers within the ion trap and/or the fragmentation device. The one or more axial RF or axial pseudo-potential barriers within the ion trap and/or the fragmentation device are preferably provided at an exit region of the ion trap and/or the fragmentation device. However, according to other less preferred embodiments the one or more axial RF or axial pseudo-potential barriers may be provided at different positions or locations within the ion trap and/or the fragmentation device.

According to an embodiment the method further comprises:

(i) applying one or more transient DC voltages or DC potentials or one or more transient DC voltage or potential waveforms to electrodes comprising the ion trap and/or the fragmentation device in order to drive, urge, force or compel at least some ions towards the one or more axial RF or axial pseudo-potential barriers; and/or (ii) applying one or more axial DC voltage gradients across electrodes comprising the ion trap and/or the fragmentation device in order to drive, urge, force or compel at least some ions towards the one or more axial RF or axial pseudo-potential barriers; and/or (iii) applying a multi-phase RF voltage to electrodes comprising the ion trap and/or the fragmentation device in order to drive, urge, force or compel at least some ions towards the one or more axial RF or axial pseudo-potential barriers; and/or (iv) driving, urging, forcing or compelling at least some ions towards the one or more axial RF or axial pseudo-potential barriers by entraining the ions in a flow of gas towards the one or more axial RF or axial pseudo-potential barriers.

According to an embodiment the method further comprises progressively reducing the height of one or more axial RF or axial pseudo-potential barriers within the ion trap and/or the fragmentation device so that ions having progressively lower mass to charge ratios are able to overcome the one or more axial RF or axial pseudo-potential barriers and emerge from the ion trap and/or the fragmentation device.

According to an embodiment the method further comprises providing a quadrupole rod set mass analyser downstream of the ion trap and/or the fragmentation device and operating the quadrupole rod set mass analyser in a reverse scan mode of operation so as initially to transmit ions having a relatively high mass to charge ratio and to progressively transmit ions having relatively lower mass to charge ratios.

According to an embodiment the quadrupole rod set mass analyser is preferably scanned in synchronism with the mass or mass to charge ratio selective release of ions from the ion trap and/or the fragmentation device.

According to an embodiment the method further comprises pulsing gas into the ion trap and/or the fragmentation device. According to an embodiment the method may further comprise maintaining the pressure within the ion trap and/or the fragmentation device for a period of time at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-6}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

According to a particularly preferred embodiment the ion trap and/or fragmentation device is preferably maintained at a pressure $>\mathbf{10^{-3}}$ mbar.

According to an aspect of the present invention there is provided a mass spectrometer comprising:

an ion trap and a fragmentation device arranged upstream or downstream of the ion trap;

wherein in a mode of operation ions of interest are isolated within the ion trap and at least some of the ions of interest are fragmented to form a plurality of first fragment ions, wherein at least some of the first fragment ions are then transferred to the fragmentation device and wherein at least some of the first fragment ions are fragmented within the fragmentation device to form a plurality of second fragment ions.

In a mode of operation the ion trap preferably has an effective first low mass or mass to charge ratio cut-off and wherein the fragmentation device preferably has an effective second low mass or mass to charge ratio cut-off, wherein the second low mass or mass to charge ratio cut-off is preferably substantially lower than the first low mass or mass to charge ratio cut-off.

According to an embodiment the second low mass or mass to charge ratio cut-off is at least 5%, 10%, 15%, 20%, 25%, 30%, 35%, 40%, 45%, 50%, 55%, 60%, 65%, 70%, 75%, 80%, 85%, 90%, 95% or 100% lower than the first low mass or mass to charge ratio cut-off.

According to an embodiment the ion trap is selected from the group consisting of: (i) a quadrupole rod set; (ii) a hexapole rod set; (iii) an octapole or higher order rod set; and (iv) an ion tunnel or ion funnel ion trap comprising a plurality of electrodes each having one or more apertures through which ions are transmitted in use.

According to an embodiment the fragmentation device is selected from the group consisting of: (i) a quadrupole rod set; (ii) a hexapole rod set; (iii) an octapole or higher order rod set; and (iv) an ion tunnel or ion funnel ion trap comprising a plurality of electrodes each having one or more apertures through which ions are transmitted in use.

The ion trap preferably comprises a different number of electrodes or is structurally different to the fragmentation device so that for ions having a particular mass to charge ratio the ion trap has a first low mass cut-off and the fragmentation device has a second different (lower) low mass cut-off.

According to an embodiment the second low mass or mass to charge ratio cut-off is at least 5%, 10%, 15%, 20%, 25%, 30%, 35%, 40%, 45%, 50%, 55%, 60%, 65%, 70%, 75%, 80%, 85%, 90%, 95% or 100% lower than the first low mass or mass to charge ratio cut-off.

The ion trap preferably comprises a first plurality of electrodes having a first spacing and/or aperture size and/or diameter and the fragmentation device preferably comprises a second plurality of electrodes having a second different spacing and/or aperture size and/or diameter.

The mass spectrometer preferably further comprises a device arranged and adapted to supply an AC or RF voltage to electrodes comprising the ion trap wherein:

(a) the AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and (b) the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer further preferably comprises a device arranged and adapted to supply an AC or RF voltage to the electrodes comprising the fragmentation device wherein:

(a) the AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and (b) the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5

MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer preferably further comprises an ion accumulation device or ion trap arranged and adapted to accumulate at least some of the second fragment ions, wherein in a mode of operation at least some of the second fragment ions are released from the ion accumulation device or ion trap and are transferred to a mass analyser for subsequent mass analysis.

In a mode of operation the second fragment ions are preferably transferred to a mass analyser for subsequent mass analysis. The mass analyser is preferably selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap (RTM) mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

According to an embodiment the mass spectrometer further comprises a device arranged and adapted to provide one or more axial RF or axial pseudo-potential barriers within the ion trap and/or the fragmentation device. The one or more axial RF or axial pseudo-potential barriers within the ion trap and/or the fragmentation device are preferably provided at an exit region of the ion trap and/or the fragmentation device. However, according to other less preferred embodiments the one or more axial RF or axial pseudo-potential barriers may be provided at different positions or locations within the ion trap and/or the fragmentation device.

According to an embodiment the mass spectrometer further comprises:

(i) a device arranged and adapted to apply one or more transient DC voltages or DC potentials or one or more transient DC voltage or potential waveforms to electrodes comprising the ion trap and/or the fragmentation device in order to drive, urge, force or compel at least some ions towards the one or more axial RF or axial pseudo-potential barriers; and/or (ii) a device arranged and adapted to apply one or more axial DC voltage gradients across electrodes comprising the ion trap and/or the fragmentation device in order to drive, urge, force or compel at least some ions towards the one or more axial RF or axial pseudo-potential barriers; and/or (iii) a device arranged and adapted to apply a multi-phase RF voltage to electrodes comprising the ion trap and/or the fragmentation device in order to drive, urge, force or compel at least some ions towards the one or more axial RF or axial pseudo-potential barriers; and/or (iv) a device arranged and adapted to drive, urge, force or compel at least some ions towards the one or more axial RF or axial pseudo-potential barriers by entraining the ions in a flow of gas towards the one or more axial RF or axial pseudo-potential barriers.

According to an embodiment the mass spectrometer further comprises a device arranged and adapted to progressively reduce the height of one or more axial RF or axial pseudo-potential barriers within the ion trap and/or the fragmentation device so that ions having progressively lower mass to charge ratios are able to overcome the one or more axial RF or axial pseudo-potential barriers and emerge from the ion trap and/or the fragmentation device.

According to an embodiment the mass spectrometer further comprises a quadrupole rod set mass analyser arranged downstream of the ion trap and/or the fragmentation device wherein the quadrupole rod set mass analyser is arranged to be operated in a reverse scan mode of operation so as initially to transmit ions having a relatively high mass to charge ratio and to progressively transmit ions having relatively lower mass to charge ratios.

The quadrupole rod set mass analyser is preferably scanned in synchronism with the mass or mass to charge ratio selective release of ions from the ion trap and/or the fragmentation device.

The mass spectrometer may further comprise a device for pulsing gas into the ion trap and/or the fragmentation device. The device is preferably arranged to maintain, in use, the pressure within the ion trap and/or the fragmentation device for a period of time at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi)

<10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

According to a particularly preferred embodiment the ion trap and/or fragmentation device is preferably maintained at a pressure $>10^{-3}$ mbar.

According to an aspect of the present invention there is provided a computer program executable by the control system of a mass spectrometer comprising an ion trap and a fragmentation device arranged either upstream or downstream of the ion trap, the computer program being arranged to cause the control system:

(i) to isolate ions of interest in the ion trap;

(ii) to fragment at least some of the ions of interest to form a plurality of first fragment ions;

(iii) to transfer at least some of the first fragment ions to the fragmentation device; and (iv) to fragment at least some the first fragment ions within the fragmentation device to form a plurality of second fragment ions.

According to an aspect of the present invention there is provided a computer readable medium comprising computer executable instructions stored on the computer readable medium, the instructions being arranged to be executable by a control system of a mass spectrometer comprising an ion trap and a fragmentation device arranged either upstream or downstream of the ion trap, the computer program being arranged to cause the control system:

(i) to isolate ions of interest in the ion trap;

(ii) to fragment at least some of the ions of interest to form a plurality of first fragment ions;

(iii) to transfer at least some of the first fragment ions to the fragmentation device; and (iv) to fragment at least some the first fragment ions within the fragmentation device to form a plurality of second fragment ions.

The computer readable medium is preferably selected from the group consisting of: (i) a ROM; (ii) an EAROM; (iii) an EPROM; (iv) an EEPROM; (v) a flash memory; (vi) an optical disk; (vii) a RAM; and (viii) a hard disk drive.

According to an aspect of the present invention there is provided a method of mass spectrometry comprising:

isolating ions of interest in an ion trap;

fragmenting at least some of the ions of interest to form a plurality of first fragment ions;

transferring at least some of the first fragment ions to a fragmentation device which is arranged either upstream or downstream of the ion trap; fragmenting at least some the first fragment ions within the fragmentation device to form a plurality of second fragment ions;

accumulating at least some of the second fragment ions in an ion accumulation device or ion trap; and releasing at least some of the second fragment ions from the ion accumulation device or ion trap and transferring the second fragment ions to a mass analyser for subsequent mass analysis.

According to an aspect of the present invention there is provided a mass spectrometer comprising:

an ion trap and a fragmentation device arranged upstream or downstream of the ion trap;

wherein in a mode of operation ions of interest are isolated within the ion trap and at least some of the ions of interest are fragmented to form a plurality of first fragment ions, wherein at least some of the first fragment ions are then transferred to the fragmentation device and wherein at least some of the first fragment ions are fragmented within the fragmentation device to form a plurality of second fragment ions;

further comprising an ion accumulation device or ion trap arranged and adapted to accumulate at least some of the second fragment ions, wherein in a mode of operation at least some of the second fragment ions are released from the ion accumulation device or ion trap and are transferred to a mass analyser for subsequent mass analysis.

According to an aspect of the present invention there is provided a method of mass spectrometry comprising:

isolating ions of interest in an ion trap;

fragmenting at least some of the ions of interest to form a plurality of first fragment ions;

isolating first fragment ions of interest in the ion trap;

fragmenting at least some of the first fragment ions of interest to form a plurality of second fragment ions;

transferring at least some of the second fragment ions to a fragmentation device which is arranged either upstream or downstream of the ion trap; and fragmenting at least some the second fragment ions within the fragmentation device to form a plurality of third fragment ions.

According to an aspect of the present invention there is provided a mass spectrometer comprising:

an ion trap and a fragmentation device arranged upstream or downstream of the ion trap;

wherein in a mode of operation ions of interest are isolated within the ion trap and at least some of the ions of interest are fragmented to form a plurality of first fragment ions, wherein at least some of the first fragment ions are then isolated in the ion trap and are then fragmented to form a plurality of second fragment ions, wherein at least some of the second fragment ions are transferred to the fragmentation device and wherein at least some of the second fragment ions are fragmented within the fragmentation device to form a plurality of third fragment ions.

Methods of mass spectrometry and mass spectrometers arranged to perform MS/MS/MS ($MS^3$) or MS/MS/MS/MS ($MS^4$) are disclosed above and are intended to fall within the scope of the present invention. Further less preferred embodiments are also contemplated wherein $MS^5$, $MS^6$ or higher multiple stages of fragmentation may be performed. Embodiments are also contemplated wherein one or more stages of fragmentation may initially be performed in the ion trap and then one or more stages of fragmentation may then subsequently be performed in the fragmentation device. For example, ions may be fragmented once, twice or three times in the ion trap and then fragmented again once, twice or three times in the fragmentation device.

According to an embodiment there is provided a mass spectrometer comprising an ion trap and in which successive stages of ion isolation and ion fragmentation are preferably performed. The ions are then preferably ejected from the ion trap to a fragmentation device. The ions are preferably subjected to a final stage of fragmentation in the fragmentation device. The fragmentation device which is preferably used for the final stage of fragmentation preferably possesses a broader mass or mass to charge ratio range than that of the ion trap which was used for the previous stages of fragmentation. Fragment ions which emerge from the fragmentation device may optionally be accumulated in an ion accumulation device prior to mass analysis by a mass analyser.

A preferred embodiment of the present invention allows the isolation and fragmentation steps to be performed in a linear ion trap. However, the final fragmentation step is preferably performed in a fragmentation device which is preferably arranged downstream of the linear ion trap. The final fragmentation step is preferably not limited by the low mass cut-off which would otherwise be imposed by the linear ion trap and therefore the entire useful mass or mass to charge ratio range may be acquired by a subsequent mass analyser.

According to another preferred embodiment the fragmentation device may be arranged upstream of a device for accumulating the fragment ions generated by the fragmentation device or both devices may be combined into a single device.

If the accumulating device (e.g. a further ion trap) is arranged upstream of the final mass analyser, than linked scan experiments can be performed where the ions are ejected from the accumulation device in synchronism with the mass analysis being performed by the mass analyser.

The fragmentation device preferably comprises an ion tunnel collision cell comprising a plurality of electrodes each preferably having at least one aperture through which ions are preferably transmitted in use.

According to an embodiment the fragmentation device may further comprise a transient DC voltage device arranged and adapted to apply one or more transient DC voltages or potentials or one or more transient DC voltage or potential waveforms to at least some of the plurality of electrodes forming the fragmentation device. The transient DC voltage device preferably urges, forces, drives or propels at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the fragmentation device.

The fragmentation device preferably comprises an entrance region, a central region and an exit region wherein the entrance region and/or the central region and/or the exit region is preferably maintained in use at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to 10−2 mbar; (xxiv) $10^{-4}$ to $10^{-3}$ mbar; and (xxv) $10^{-5}$ to $10^{-4}$ mbar.

According to an embodiment the fragmentation device may comprise either: (i) an ion tunnel or ion funnel ion guide; (ii) a multipole rod set ion guide; (iii) an axially segmented multipole rod set ion guide; or (iv) a plurality of plate electrodes arranged generally in the plane of ion travel.

According to an embodiment the ion trap and/or the fragmentation device preferably further comprises a device arranged and adapted to supply an AC or RF voltage to the electrodes comprising the ion trap and/or the fragmentation device. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the mass spectrometer preferably further comprises one or more ion sources preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) a sub-atmospheric pressure Electrospray ionisation ion source; and (xxii) a Direct Analysis in Real Time ("DART") ion source.

The mass spectrometer may further comprise one or more continuous or pulsed ion sources.

The mass spectrometer may further comprise one or more ion guides

According to an embodiment the mass spectrometer may further comprise one or more ion mobility separation devices and/or one or more Field Asymmetric Ion Mobility Spectrometer devices.

The mass spectrometer may further comprise one or more ion traps or one or more ion trapping regions.

According to an embodiment the fragmentation device may comprise a fragmentation device selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

According to an embodiment the mass spectrometer may comprise a further mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap (RTM) mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

According to an embodiment the mass spectrometer may further comprise one or more energy analysers or electrostatic energy analysers.

According to an embodiment the mass spectrometer may further comprise one or more ion detectors.

According to an embodiment the mass spectrometer may further comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a VVein filter.

According to an embodiment the mass spectrometer may further comprise a device or ion gate for pulsing ions towards the attenuation device and/or towards the ion trap or ion trap mass analyser.

According to an embodiment the mass spectrometer may further comprise a device for converting a substantially continuous ion beam into a pulsed ion beam.

According to an embodiment the mass spectrometer may further comprise a C-trap and a mass analyser comprising an outer barrel-like electrode and a coaxial inner spindle-like electrode. In a first mode of operation ions may be transmitted to the C-trap and may then be injected into the mass analyser. In a second mode of operation ions may be transmitted to the C-trap and may then be transmitted to a collision cell or Electron Transfer Dissociation device wherein at least some ions are fragmented into fragment ions, and wherein the fragment ions are then preferably transmitted to the C-trap before being injected into the mass analyser.

According to an embodiment the mass spectrometer may comprise a stacked ring ion guide comprising a plurality of electrodes each having an aperture through which ions are transmitted in use. The spacing of the electrodes may be arranged so as to increase along the length of the ion path. The apertures in the electrodes in an upstream section of the ion guide may have a first diameter and the apertures in the electrodes in a downstream section of the ion guide may be arranged to have a second diameter which is preferably smaller than the first diameter. Opposite phases of an AC or RF voltage are preferably applied, in use, to successive electrodes.

BRIEF DESCRIPTION OF THE DRAWINGS

Various embodiments of the present invention will now be described, by way of example only, and with reference to the accompanying drawings in which.

Figure 1:
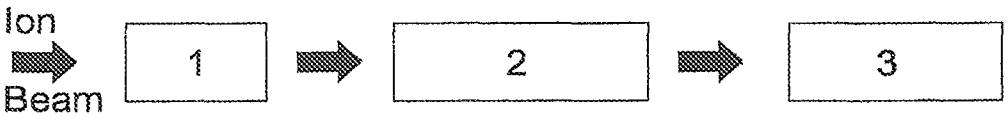
FIG. 1 shows a schematic drawing of a mass spectrometer according to a preferred embodiment of the present invention wherein ions are isolated and fragmented one or more times in an ion trap and the resulting fragment ions are then transferred to a fragmentation device arranged downstream of the ion trap and which is arranged to perform a final fragmentation step.

A preferred embodiment of the present invention will now be described with reference to FIG. 1. According to the preferred embodiment a mass spectrometer is provided comprising an ion trap 1 and a separate fragmentation device 2 which is preferably arranged downstream of the ion trap 1. The mass spectrometer preferably further comprises a mass analyser 3 which is preferably arranged downstream of the fragmentation device 2.

Figure 2:
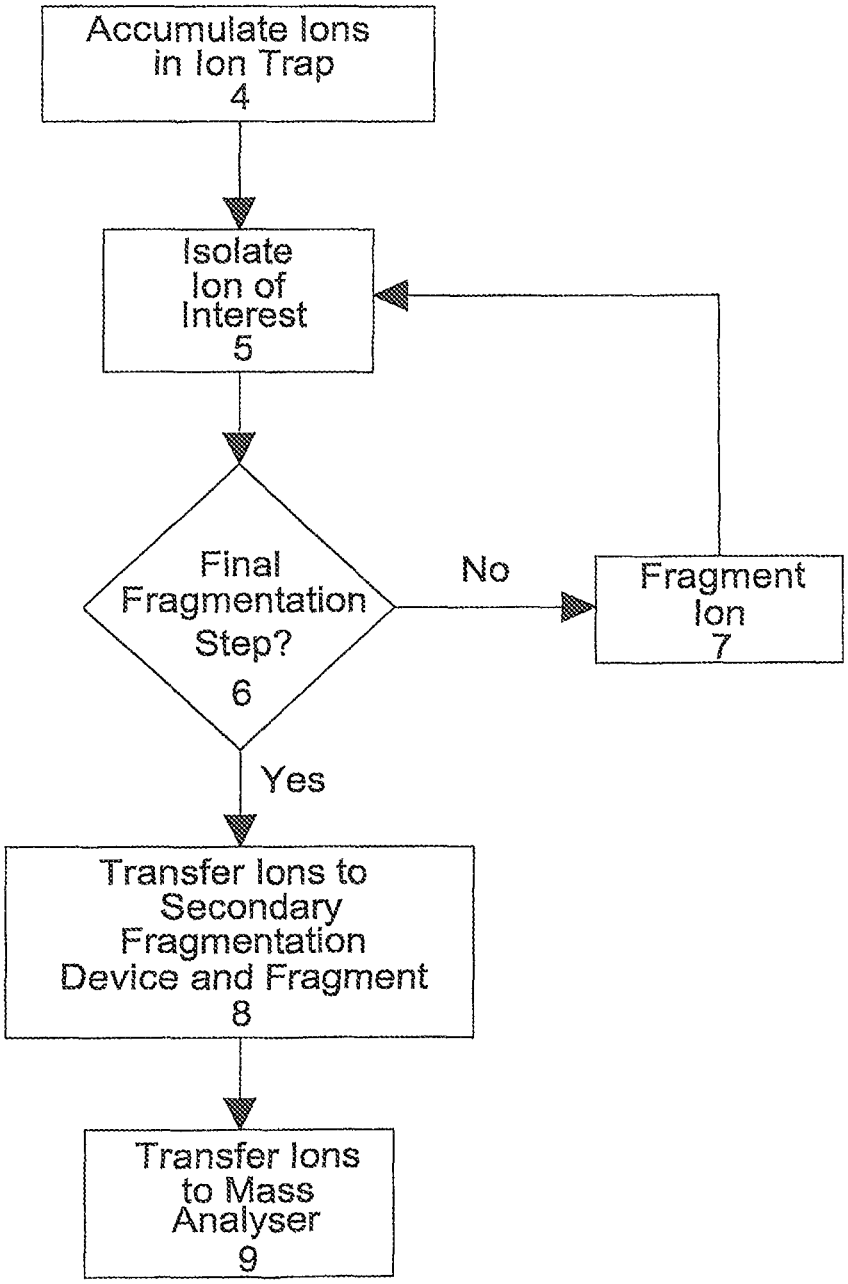
FIG. 2 shows a flow diagram illustrating an example experiment which may be performed according to an embodiment of the present invention.

FIG. 2 shows the steps which may be performed according to an embodiment of the present invention. Ions are preferably initially accumulated within the ion trap 1 during a first step 4. Once ions have been allowed to accumulate for a predetermined period of time within the ion trap 1, precursor or parent ions of interest are then preferably isolated within the ion trap 1 as a second step 5.

DETAILED DESCRIPTION OF THE PREFERRED EMBODIMENTS

According to an embodiment the ion trap 1 may comprise either a linear or 2D ion trap or a Paul or 3D ion trap. Various methods of isolating ions within the ion trap 1 may be performed including those methods of ion isolation which are disclosed, for example, in U.S. Pat. Nos. 4,749,860, 4,882,484 and 5,134,286 (the teachings of which are incorporated herein by reference).

Once the second step 5 of isolating ions in the ion trap 1 has been performed, then a third step 7 is preferably performed wherein the ions are fragmented within the ion trap 1 at least once. Ions may be fragmented within the ion trap 1 by one of several different known methods.

Once ions have been fragmented in the ion trap 1, the first generation fragment ions are then preferably subjected to a further isolation step wherein desired first generation fragment ions having a particular mass or mass to charge ratio are selected or otherwise isolated whilst undesired first generation fragment ions are ejected from the ion trap 1.

The steps of fragmentation and isolation within the ion trap 1 may be performed multiple times until a final fragmentation step 6 is desired to be performed. If it is desired to perform a final fragmentation step 6, then the isolated fragment ions of interest are preferably transferred to a secondary fragmentation device 2 which is preferably arranged downstream of the ion trap 1. The secondary fragmentation device 2 preferably comprises a gas cell or an ion tunnel collision cell 2.

The secondary fragmentation device may comprise a fragmentation device selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

According to the preferred embodiment ions are accelerated into the secondary fragmentation device 2 with sufficient kinetic energy such that the fragment ions are further fragmented upon entering the secondary fragmentation device 2 by Collision Induced Dissociation ("CID").

After the final stage of fragmentation has been performed within the fragmentation device 2, the fragment ions are then preferably transferred to a mass analyser 3 for subsequent mass analysis according to a further step 9. The mass analyser 3 is preferably arranged downstream of the fragmentation device 2.

Figure 3A:
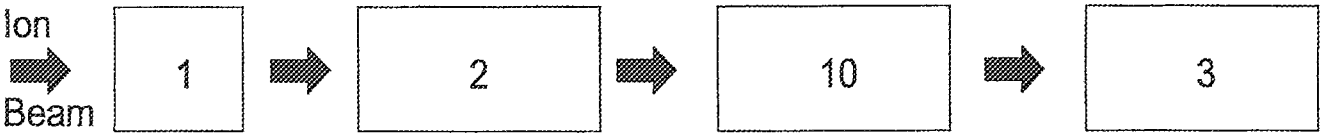
FIG. 3A shows a schematic drawing of another embodiment of the present invention wherein an ion accumulation device is arranged downstream of the fragmentation device and FIG. 3B shows a variation of the embodiment shown in FIG. 3A wherein the fragmentation device and an ion accumulation device are combined in the same device.
Figure 3B:
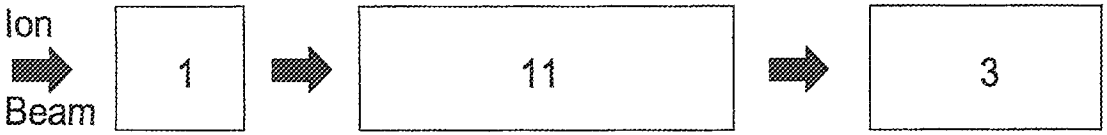

Other embodiments are also contemplated and will now be described in more detail with reference to FIGS. 3A and 3B. According to an embodiment as shown in FIG. 3A, a separate accumulation device 10 may be provided downstream of the fragmentation device 2 and upstream of the mass analyser 3. Alternatively, according to another embodiment as shown in FIG. 3B, a combined fragmentation and accumulation device 11 may be provided. According to both the embodiments shown in FIGS. 3A and 3B, fragment ions formed in the fragmentation device 2,11 in the final fragmentation step are preferably accumulated prior to subsequent mass analysis by the mass analyser 3. This allows, for example, ions from multiple MS/MS. MS/MS/MS or $MS^n$ experiments to be accumulated followed by a single mass analysis stage, Alternatively, the accumulation of ions in the accumulation device 10,11 allows synchronised ejection of ions from the accumulation device 10,11 to the mass analyser 3. An example of such a use would be where the final mass analyser 3 comprises a scanning quadrupole.

With or without accumulation, ions are preferably not presented in a continuous beam to the quadrupole but are preferably delivered as a pulse of ions when the confining field holding the ions in the ion trap are reduced/removed. This may lead to all of the ions arriving at the quadrupole in a shorter time period than the time it would take to perform a single scan. However, if the accumulation device is a low resolution ion trap then it can be used to eject ions to the scanning quadrupole in synchronism with the masses or mass to charge ratios being monitored as the quadrupole is scanned in accordance with the techniques disclosed, for example, in U.S. Pat. No. 7,405,401, GB060016878 and GB060011062 (the contents of which are incorporated herein by reference).

Figure 4:
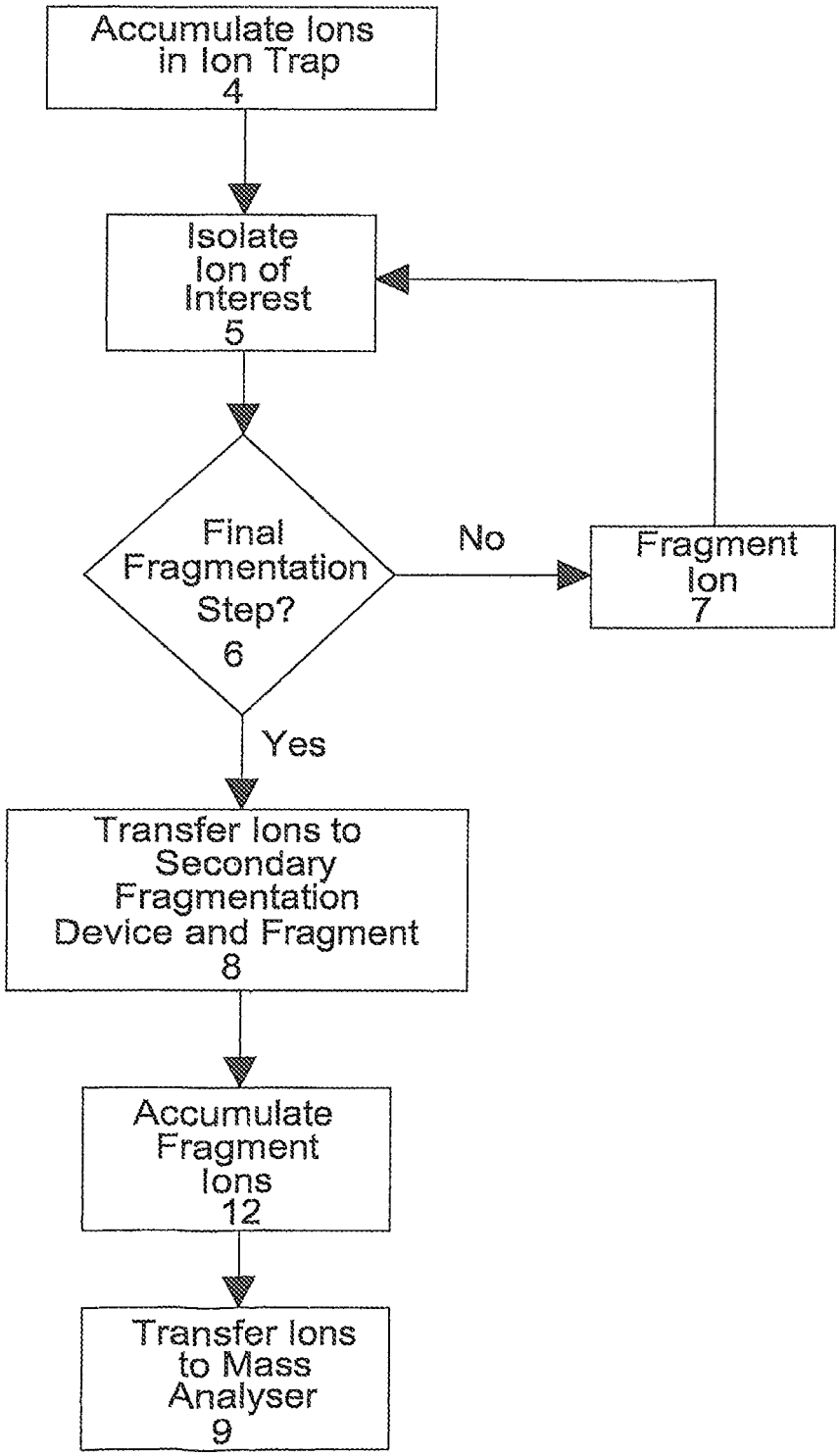
FIG. 4 shows an example experiment which may be performed using a mass spectrometer as shown in either FIG. 3A or FIG. 3B and in accordance with an embodiment of the present invention.

FIG. 4 shows an example experiment which may be performed using a mass spectrometer as shown and described above in relation to either FIG. 3A or FIG. 3B wherein fragment ions generated in the fragmentation device 2 are then subsequently accumulated in an accumulation device 10,11 prior to being transferred to the mass analyser 3.

Ions are preferably initially accumulated within the ion trap 1 during a first step 4. Once ions have been allowed to accumulate for a predetermined period of time within the ion trap 1, precursor or parent ions of interest are then preferably isolated within the ion trap 1 as a second step 5.

According to an embodiment the ion trap 1 may comprise either a linear or 2D ion trap or a Paul or 3D ion trap. Various methods of isolating ions within the ion trap 1 may be performed including those methods of ion isolation which are disclosed, for example, in U.S. Pat. Nos. 4,749,860, 4,882,484 and 5,134,286 (the teachings of which are incorporated herein by reference).

Once the second step 5 of isolating ions in the ion trap 1 has been performed, then a third step 7 is preferably performed wherein the ions are fragmented within the ion trap 1 at least once. Ions may be fragmented within the ion trap 1 by one of several different known methods.

Once ions have been fragmented in the ion trap 1, the first generation fragment ions are then preferably subjected to a further isolation step wherein desired first generation fragment ions having a particular mass or mass to charge ratio are selected or otherwise isolated whilst undesired first generation fragment ions are ejected from the ion trap 1.

The steps of fragmentation and isolation within the ion trap 1 may be performed multiple times until a final fragmentation step 6 is desired to be performed. If it is desired to perform a final fragmentation step 6, then the isolated fragment ions of interest are preferably transferred to a secondary fragmentation device 2 which is preferably arranged downstream of the ion trap 1. The secondary fragmentation device 2 preferably comprises a gas cell or an ion tunnel collision cell 2.

The secondary fragmentation device may comprise a fragmentation device selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

According to the preferred embodiment ions are accelerated into the secondary fragmentation device 2 with sufficient kinetic energy such that the fragment ions are further fragmented upon entering the secondary fragmentation device 2 by Collision Induced Dissociation ("CID").

After the final stage of fragmentation has been performed within the fragmentation device 2, the fragment ions are then preferably accumulated in an ion accumulation device 10,11 according to a further step 12. The ion accumulation device 10,11 may comprise either a discrete ion trap 10 or may comprise a portion of the fragmentation device 2. Ions are then preferably released from the ion accumulation device 10,11 and are transmitted to the mass analyser 3 for subsequent mass analysis according to a further step 9. The mass analyser 3 is preferably arranged downstream of the fragmentation device 2.

According to a further (unillustrated) embodiment, an ion mobility spectrometer or ion mobility separator may be provided after or downstream of the accumulation device 10,11.

Figure 5:
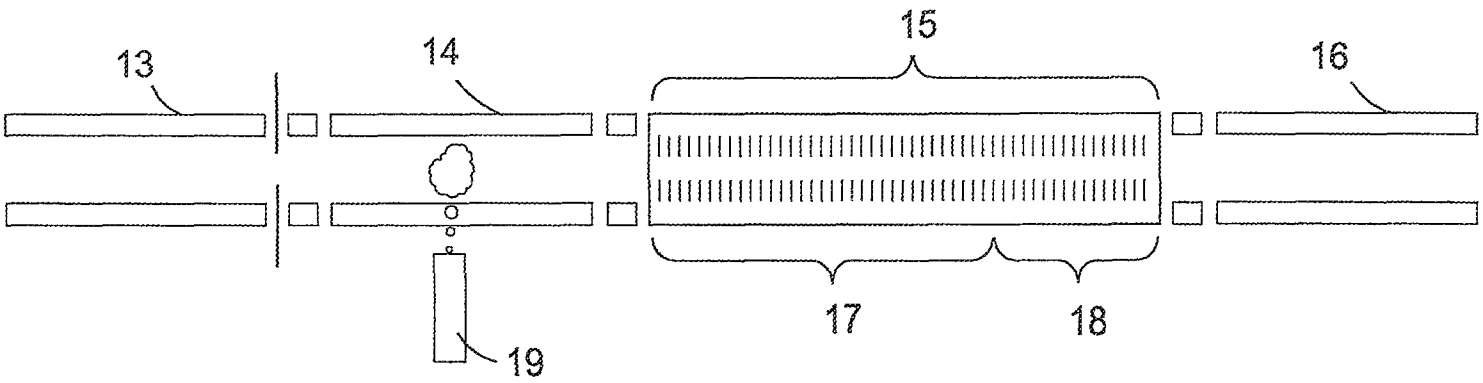
FIG. 5 shows a mass spectrometer according to an embodiment comprising an ion guide, a quadrupole ion trap, an ion tunnel collision cell arranged to have an upstream ion storage region and a downstream ion ejection region and a quadrupole mass analyser.

FIG. 5 shows a mass spectrometer according to a particularly preferred embodiment of the present invention. The mass spectrometer comprises an ion guide 13 and a quadrupole ion trap 14 arranged downstream of the ion guide 13. In order to perform a MS/MS/MS experiment parent ions having a particular mass to charge ratio are firstly isolated within the quadruple ion trap 14 by, for example, mass selective ejection. The isolated parent ions are then preferably fragmented into first generation fragment ions by applying a tickle voltage between one opposite pair of quadrupole rods which form the quadrupole ion trap 14.

A pulsed gas valve 19 may be used in combination with the ion trap 14 in order temporarily to increase the gas pressure within the ion trap 14 whilst the parent ions are being fragmented to form first generation fragment ions. Increasing the gas pressure within the ion trap 14 helps to improve the fragmentation efficiency without drastically increasing the pumping load for the vacuum system.

After the first fragmentation step has been performed, first generation fragment ions having a particular mass or mass to charge ratio are then preferably isolated within the ion trap 14. The isolated first generation fragment ions are then preferably ejected from the ion trap 14 at relatively high energy into an upstream storage region 17 which forms part of a fragmentation device or collision cell 15. The fragmentation device or collision cell 15 preferably also includes a downstream ion ejection region 18. According to an embodiment, the first generation fragment ions are preferably caused to fragment by Collision Induced Dissociation ("CID") into second generation fragment ions upon entering the upstream storage region 17 of the fragmentation device or collision cell 15. The broad mass or mass to charge ratio range of the fragmentation device or collision cell 15 preferably ensures that there is no significant low mass or low mass to charge ratio cut-off effect.

Once all first generation fragment ions have entered the upstream storage region 17 of the collision cell 15 and have been fragmented to form second generation fragment ions, then the second generation fragment ions are then preferably transferred from the upstream storage region 17 of the collision cell 15 to a downstream ejection region 18 of the collision cell 15.

According to an embodiment a quadrupole mass filter or mass analyser 16 is preferably arranged downstream of the fragmentation device or collision cell 15. The second generation fragment ions which are preferably ejected from the downstream ejection region 18 of the collision cell 15 are preferably ejected in synchronism with the masses or mass to charge ratios being monitored by the quadrupole 16 which is preferably being operated in a reverse scanning mode of operation. This arrangement preferably allows a full mass spectrum to be acquired at high sensitivity. During the time that the linked mass ejection and mass analysis is progressing, a second MS/MS/MS isolation and fragmentation step may be performed simultaneously as the processes are spatially separated.

According to an embodiment ions may be accumulated in the ion guide 13 arranged upstream of the ion trap 14 whilst a MS/MS/MS experiment is being performed in order to achieve 100% sampling duty cycle. The mass spectrometer according to the preferred embodiment therefore has a very high efficiency and enables particularly sensitive experiments to be performed.

Although a method of performing a MS/MS/MS experiment has been described above with reference to FIG. 5, it be appreciated that the method can be adapted so as to perform either a MS/MS experiment with a single stage of fragmentation or an $MS^n$ experiment with multiple stages of fragmentation (wherein n=4, 5, 6, 7 or >7).

Although the present invention has been described with reference to preferred embodiments, it will be apparent to those skilled in the art that various modifications in form and detail may be made to the particular embodiments discussed above without departing from the scope of the invention as set forth in the accompanying claims.

The invention claimed is:

1. A method of mass spectrometry comprising:

accumulating ions within an ion trap;

isolating ions of interest within said ion trap;

fragmenting at least some of said ions of interest within said ion trap to form a plurality of first fragment ions;

transferring at least some of said first fragment ions to a fragmentation device which is arranged either upstream or downstream of said ion trap; and fragmenting at least some said first fragment ions within said fragmentation device to form a plurality of second fragment ions.

2. A method as claimed in claim 1, wherein said ion trap is operated in a mode of operation and has an effective first low mass or mass to charge ratio cut-off and wherein said fragmentation device is operated in a mode of operation and has an effective second low mass or mass to charge ratio cut-off, wherein said second low mass or mass to charge ratio cut-off is substantially lower than said first low mass or mass to charge ratio cut-off.

3. A method as claimed in claim 1, wherein said ion trap comprises a different number of electrodes or is structurally different to said fragmentation device so that for ions having a particular mass to charge ratio said ion trap has a first low mass cut-off and said fragmentation device has a second different low mass cut-off.

4. A method as claimed in claim 1, wherein said ion trap comprises a first plurality of electrodes having a first spacing or aperture size or diameter and wherein said fragmentation device comprises a second plurality of electrodes having a second different spacing or aperture size or diameter.

5. A method as claimed in claim 1, further comprising:

accumulating at least some of said second fragment ions in an ion accumulation device or ion trap; and releasing at least some of said second fragment ions from said ion accumulation device or ion trap and transferring said second fragment ions to a mass analyser for subsequent mass analysis.

6. A method as claimed in claim 1, further comprising transferring said second fragment ions to a mass analyser for subsequent mass analysis.

7. A method as claimed in claim 1 wherein said isolated ions of interest are:

precursor or parent ions of interest; or fragment ions of interest.

8. A mass spectrometer comprising:

an ion trap and a fragmentation device arranged upstream or downstream of said ion trap;

wherein in a mode of operation ions are accumulated within said ion trap, ions of interest are isolated within said ion trap and at least some of said ions of interest are fragmented within said ion trap to form a plurality of first fragment ions, wherein at least some of said first fragment ions are then transferred to said fragmentation device and wherein at least some of said first fragment ions are fragmented within said fragmentation device to form a plurality of second fragment ions.

9. A mass spectrometer as claimed in claim 8, wherein in a mode of operation said ion trap has an effective first low mass or mass to charge ratio cut-off and wherein said fragmentation device has an effective second low mass or mass to charge ratio cut-off, wherein said second low mass or mass to charge ratio cut-off is substantially lower than said first low mass or mass to charge ratio cut-off.

10. A mass spectrometer as claimed in claim 8, wherein said ion trap comprises a different number of electrodes or is structurally different to said fragmentation device so that for ions having a particular mass to charge ratio said ion trap has a first low mass cut-off and said fragmentation device has a second different low mass cut-off.

11. A mass spectrometer as claimed in claim 8, wherein said ion trap comprises a first plurality of electrodes having a first spacing or aperture size or diameter and wherein said fragmentation device comprises a second plurality of electrodes having a second different spacing or aperture size or diameter.

12. A mass spectrometer as claimed in claim 8, further comprising an ion accumulation device or ion trap arranged and adapted to accumulate at least some of said second fragment ions, wherein in a mode of operation at least some of said second fragment ions are released from said ion accumulation device or ion trap and are transferred to a mass analyser for subsequent mass analysis.

13. A mass spectrometer as claimed in claim 8, wherein in a mode of operation said second fragment ions are transferred to a mass analyser for subsequent mass analysis.

14. A mass spectrometer as claimed in claim 8, wherein said isolated ions of interest are:

precursor or parent ions of interest; or fragment ions of interest.

15. A method of mass spectrometry comprising:

isolating ions of interest within an ion trap;

fragmenting at least some of said ions of interest within said ion trap to form a plurality of first fragment ions;

isolating first fragment ions of interest within said ion trap;

fragmenting at least some of said first fragment ions of interest within said ion trap to form a plurality of second fragment ions;

transferring at least some of said second fragment ions to a fragmentation device which is arranged either upstream or downstream of said ion trap; and fragmenting at least some said second fragment ions within said fragmentation device to form a plurality of third fragment ions.

16. A mass spectrometer comprising:

an ion trap and a fragmentation device arranged upstream or downstream of said ion trap;

wherein in a mode of operation ions of interest are isolated within said ion trap and at least some of said ions of interest are fragmented within said ion trap to form a plurality of first fragment ions, wherein at least some of said first fragment ions are then isolated within said ion trap and are then fragmented within said ion trap to form a plurality of second fragment ions, wherein at least some of said second fragment ions are transferred to said fragmentation device and wherein at least some of said second fragment ions are fragmented within said fragmentation device to form a plurality of third fragment ions.

* * * * *